US005625437A

United States Patent [19]

Furukawa

[11] Patent Number: 5,625,437

[45] Date of Patent: Apr. 29, 1997

[54] IMAGE FORMING APPARATUS

[75] Inventor: Kimiaki Furukawa, Tagata-gun, Japan

[73] Assignee: Kabushiki Kaisha TEC, Shizuoka, Japan

[21] Appl. No.: 492,813

[22] Filed: Jun. 20, 1995

[30] Foreign Application Priority Data

Jun. 21, 1994 [JP] Japan ..... 6-139203

[51] Int. Cl.[6] ..... G03G 15/00

[52] U.S. Cl. ..... 399/107

[58] Field of Search ..... 355/200, 210, 355/211; 347/138, 152

[56] References Cited

U.S. PATENT DOCUMENTS

| | | | |
|---|---|---|---|
| 4,785,319 | 11/1988 | Fujino et al. | 347/138 |
| 4,796,037 | 1/1989 | Takada et al. | 347/138 |
| 4,873,548 | 10/1989 | Kobayashi et al. | 355/200 |
| 5,018,806 | 5/1991 | Nakajima | 355/211 X |
| 5,059,991 | 10/1991 | Morisawa | 355/215 X |
| 5,062,003 | 10/1991 | Kawabata | 355/202 X |
| 5,063,409 | 11/1991 | Nakajima | 355/200 |
| 5,095,334 | 3/1992 | Nukaya | 355/210 |
| 5,105,221 | 4/1992 | Takahashi et al. | 355/210 |
| 5,155,527 | 10/1992 | Gokita et al. | 355/210 X |
| 5,196,891 | 3/1993 | Shimazaki et al. | 355/211 X |
| 5,227,841 | 7/1993 | Takahashi et al. | 355/200 |
| 5,309,211 | 5/1994 | Yoshioka | 355/200 X |
| 5,436,707 | 7/1995 | Ogano et al. | 355/210 X |

*Primary Examiner*—Matthew S. Smith

*Attorney, Agent, or Firm*—Oblon, Spivak, McClelland, Maier & Neustadt, P.C.

[57] ABSTRACT

A body frame has a main frame portion in which a process unit for sequentially performing electrophotographic processes from charging a photosensitive member to developing an image, a fixing device, a paper supply device, and a paper transport device are fixed being positioned in their places. The body frame also has an optical frame portion in which an exposure device for throwing light in accordance with printing data on the photosensitive member charged through a charging process is fixed being positioned in its place. Namely, the body frame incorporates both the main frame portion and the optical frame portion therein and, hence, the photosensitive member of the process unit and the exposure device are mounted on one main body accurately positioned with respect to each other. Therefore, images of improved quality can be obtained. Further, since it is not necessary to provide the main frame and the optical frame separately, downsizing of the entire apparatus can be attained.

16 Claims, 2 Drawing Sheets

IMAGE FORMING APPARATUS

BACKGROUND OF THE INVENTION

1. Field of the Invention

The present invention relates to an image forming apparatus such as a laser printer provided with an exposure device.

2. Description of the Prior Art

Generally, a laser printer transfers a toner image, in an image forming and transferring portion, to a recording paper sent from a paper supply device including a paper supply roller and the like by paper transport means including a transport roller and the like and, then, allows the tonor image to be melted and fixed on the recording paper in a fixing device. The image forming and transferring portion is made up of a process unit including a photosensitive member, a charging device, a developing device, a cleaning device, and the like, an exposure device for radiating light in accordance with printing data on the photosensitive member which has been charged to thereby form an electrostatic latent image thereon, and a transfer device for transferring a visible image (tonor image), which has been developed from the electrostatic latent image on the photosensitive member by the developing device, onto the recording paper.

A frame of the image forming apparatus, in general, is made up of a body frame in which various parts other than the exposure device are to be fixed being positioned in their places, an optical frame in which the exposure device is to be fixed being positioned in its place, and an outer case for covering over the parts. Each frame will be described below.

Component parts such as the paper supply device (a paper supply roller and the like), paper transport means (a transport roller and the like), the process unit, the transfer device, and the fixing device are each fixed in the body frame which has a high rigidity by means of their respective positioning references. Usually, the body frame is formed of plate iron or synthetic resin such as acrylonitrile-butadiene-styrene resin (hereinafter referred to as ABS resin).

The exposure device is mounted on the body frame such that it is located above the image forming and transferring portion by means of positioning members (positioning references). Optical parts constituting the exposure device i.e., a polygon mirror, an Fθ lens, a reflecting mirror, and the like are extremely vulnerable to dirt because the quality of an image is apt to be easily deteriorated by dirt. Therefore, they are housed in a box-formed optical frame so that tonor dusts and the like are prevented from attaching to them. Since the optical parts are vulnerable to heat and their fixed positions with respect to each other are required to be highly precise, the optical frame is generally formed of a synthetic resin exhibiting least deformation when subjected to heat and capable of being shaped very accurately, such as polycarbonate.

Leaving each of the component parts fixed on the body frame bare of a casing is problematic in view of their external appearance, upkeeping of the functions of the component parts, safety in operation of the apparatus, and so on. Therefore, the body frame and the component parts fixed to the frame member are covered with an outer case. The outer case, in view of its function, is not required to be so rigid as the body frame or the optical frame and, hence, different materials from those of the body frame and the optical frame, such as ABS resin, are used to form it chiefly from the point of view of the good appearance it provides.

The outer case has an opening formed at its top so that attaching and detaching of the process unit, disposal of jammed paper, and the like may be facilitated and the case has a movable cover to open and shut the opening at the top. Sometimes, the exposure device is installed on the movable cover for such reasons as ease of attaching and detaching the process unit.

There are some problems with such a conventional image forming apparatus. First, it is required of modern image forming apparatus to be smaller in size and lower in cost as much as possible so that they can be used in an ever expanding field of utilization. Therefore, it is attempted to decrease the number of parts and reduce the space of installation of the photosensitive member and the like. However, there are limits in succeeding in such attempts and it is the present situation that the demands for downsizing and cost reduction are not fully satisfied.

Second, although improvements in the quality of images are also demanded of the image forming apparatus, it is difficult to meet such demands. More specifically, since the optical parts of the exposure device are fixed on the body frame by means of the optical frame, positioning members, and the like, it is difficult to achieve precise positioning of the parts with respective to the photosensitive member because the positioning is affected by such factors as dimensional accuracy of the positioning members and the like and thermal deformation. Especially, when the exposure device is installed on the movable cover, such factors as thermal deformation of the movable cover and the play in the rotation supporting structure are added to the above described factors and, hence, it becomes extremely difficult to achieve high positional accuracy of the exposure device with respect to the photosensitive member. To overcome such difficulties, it is considered effective to form the positioning members and the like of a material with very high rigidity or fix them robustly to the body frame. However, this leads to increase in cost and also makes it difficult, when, for example, attaching and detaching the process unit, to shift the exposure device such that it does not interfere with the movement of the process unit.

SUMMARY OF THE INVENTION

An object of the present invention is to provide an image forming apparatus capable of obtaining images of improved quality.

Another object of the present invention is to provide an image forming apparatus enabling downsizing thereof.

A further object of the present invention is to provide an image forming apparatus providing greater safety.

Yet another object of the present invention is to provide an image forming which is apparatus easy to maintain.

A still further object of the present invention is to provide an image forming apparatus which is easy to fabricate.

An additional object of the present invention is to provide an image forming apparatus capable of reducing cost of parts and cost of manufacturing.

This invention relates to an image forming apparatus having a body frame in which the main frame portion and the optical frame portion are formed to be integral with each other. In the main frame portion, there are fixed, positioned in their places, a process unit sequentially performing electrophotographic processes consisting of charging a photosensitive member and forming a developed image on the same, a fixing device to fix the image transferred from the photosensitive member to recording paper, a paper supply device for supplying recording paper to the process unit, and a paper transport device for guiding recording paper supplied by the paper supply device along a guide path including the process unit and the fixing device. In the optical frame portion, there are fixed, positioned in their places, optical parts constituting the exposure device for throwing light in accordance with printing data on the photosensitive member in the process unit after the charging process is performed and before the developing process is performed. Since the photosensitive member of the process unit and the exposure device are thus fixed on one body frame, accuracy of the positions of both the members with respect to each other can be improved and images of improved quality can be obtained and, further, since it is not necessary to provide the main frame and the optical frame separately, the entire apparatus can be made smaller.

DETAILED DESCRIPTION OF THE PREFERRED EMBODIMENT

Figure 1:
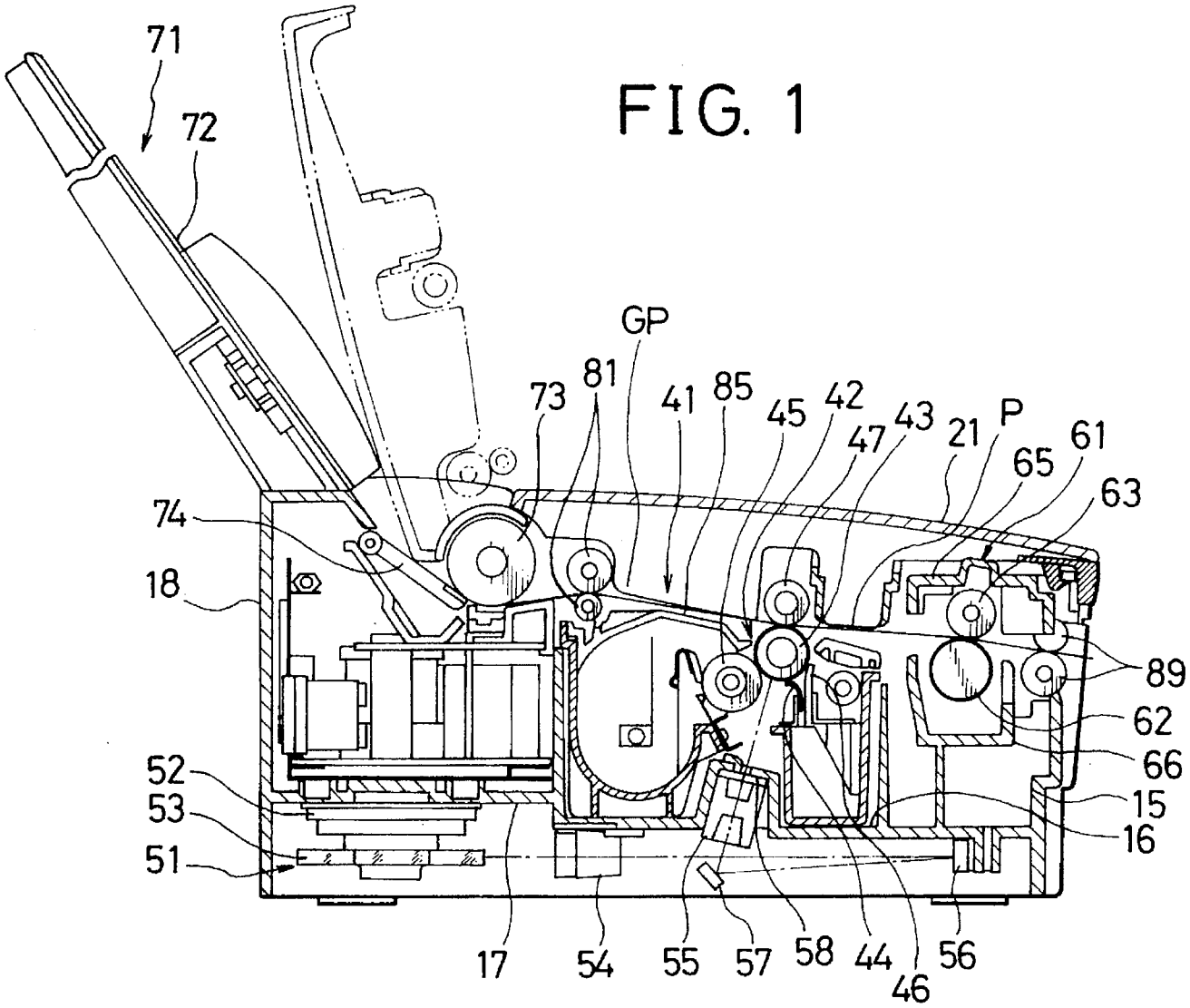
FIG. 1 is a longitudinal side view of the entire apparatus explanatory of an embodiment of the invention.
Figure 2:
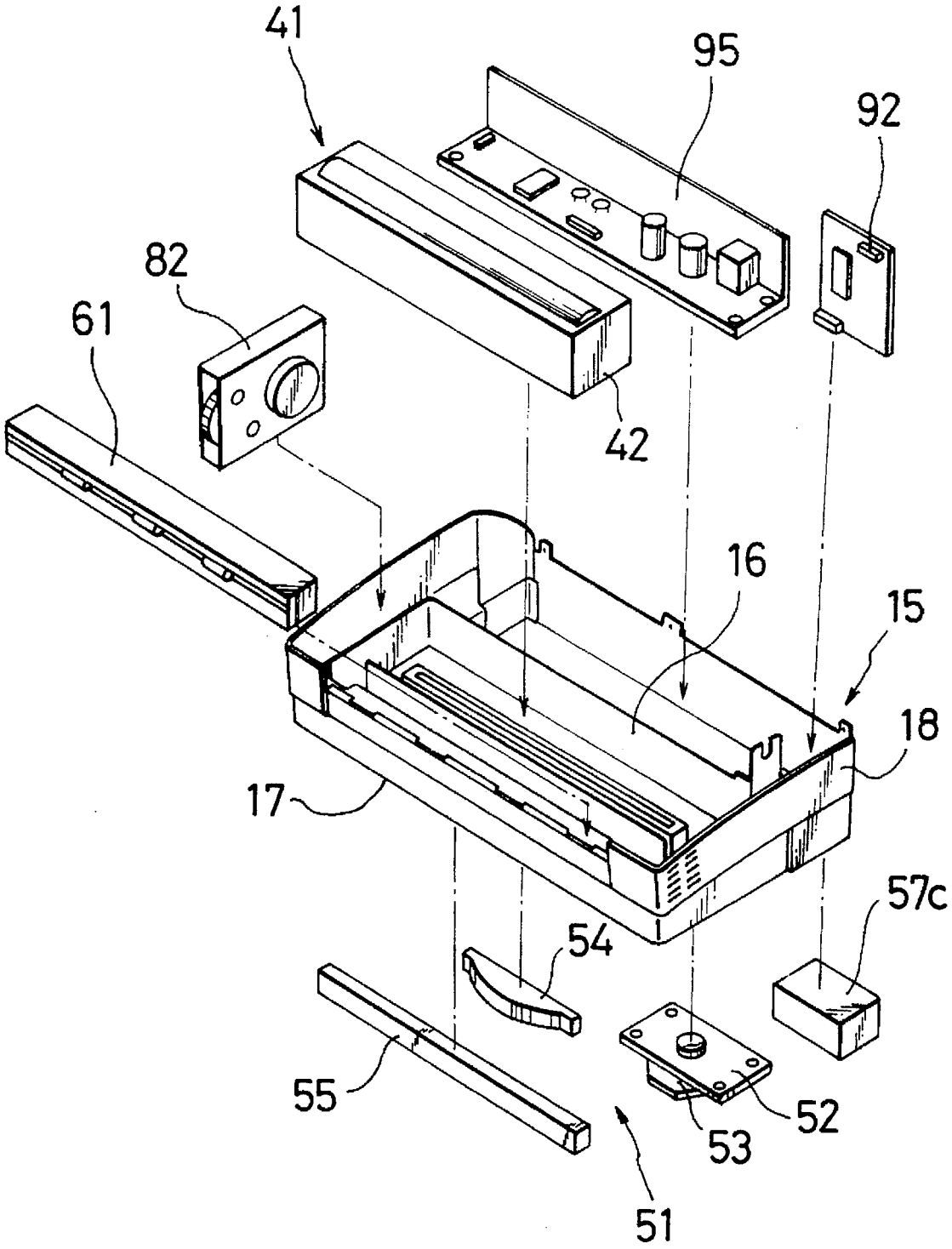
FIG. 2 is a perspective view showing the body frame and parts fixed on the body frame.

An embodiment of the invention will be described with reference to the accompanying drawings. In the image forming apparatus of the present embodiment, as shown in FIG. 1 and FIG. 2, a body frame 15 provided with positioning references of a process unit 42 including a photosensitive member 43, a fixing device 61, a paper supply device 71, and so on, also serves as an optical frame. Hence, such merits as improvement in quality of images, decrease in size, and reduction in cost can be obtained. In the apparatus of the embodiment, the body frame 15 also serves as the outer case and, hence, still more downsizing and cost reduction can be achieved. Detailed description will be given below.

The body frame 15, serving also as the optical frame, is formed of a synthetic resin material exhibiting little thermal expansion, i.e., having small coefficients of linear expansion, having high rigidity, and being relatively low in cost, and it consists of a main frame portion 16, an optical frame portion 17, and an outer case portion 18. The material of the body frame 15 is a synthetic resin material containing, as its main components, polycarbonate, ABS resin, and glass.

To the main frame portion 16, there are fixed, positioned in their predetermined places, the process unit 42 constituting the image forming and transferring portion 41, the transfer device 47, a fixing device 61, a paper supply device 71, including transport rollers 81 a paper transport device, drive means 82, an engine controlling circuit board 92, and a power unit 95. The process unit 42 is detachably supported on the main frame portion 16 and it is made up of the photosensitive member 43, a charging device 44, a developing device 45, and a cleaning device 46. The fixing device 61 is made up of a heat roller 62, a pressure roller 63, and upper and lower casings 65 and 66. The paper supply device 71 is made up of a paper supply tray 72, a paper supply roller 73, and a paper pressing plate 74, and it supplies recording paper to the process unit 42. The paper transport device is made up of a pair of transport rollers 81, and it guides the recording paper P along a guide path GP including the process unit 42 and the fixing device 61.

The optical frame portion 17 is formed by depressing the bottom side of the body frame 15. To the optical frame portion 17, there are fixed optical parts constituting an exposure device 51, by means of their respective positioning references. In the present embodiment, there are provided, as optical parts constituting the exposure device 51, a laser diode, not shown, a deflecting portion 52 including a polygon mirror 53, first and second Fθ lenses 54 and 55, two reflecting mirrors 56 and 57, a collimator unit 57C, and a dustproof glass 58. The optical parts are arranged such that a laser beam emitted from the laser diode is sent to the deflecting portion 52 through the collimator unit 57C, reflected by the polygon mirror 53, which is provided at the deflecting portion 52 and rotating at a high speed, and passed through an optical element including the first Fθ lens 54, the reflecting mirrors 56 and 57, the second Fθ lens 55, and the dustproof glass 58, to scan the exposure portion on the photosensitive member 43.

The outer case portion 18 is formed such that it covers the main frame portion 16 and various component parts (the image forming and transferring portion 41 and the like) fixed on the main frame portion 16. At the top of the outer case portion 18, there is formed an opening so that handling of the process unit 42 and disposal of jammed paper may be facilitated. The outer case portion 18 is provided with a movable cover 21 for swinging to open and shut the opening. On the movable cover 21, there is fixed the transfer device 47.

Functioning of the embodiment will be described below.

One sheet at a time is separated by the paper supply roller 73 and the paper pressing plate 74 from sheets of recording paper P set on the paper supply tray 72 and sent to the image forming and transferring portion 41 passed over a paper transport path 85. In the image forming and transferring portion 41, the photosensitive member 43 is rotated in a predetermined direction and its surface is uniformly charged by the charging device 44. Then, an electrostatic latent image is formed on the surface of the photosensitive member 43 by a laser beam emitted from the exposure device 51 according to printing data. At this time, the laser beam is allowed to correctly scan the surface of the photosensitive member 43. This is because the optical parts (such as the polygon mirror 53) constituting the exposure device 51 are held in the optical frame portion 17 of the body frame 15 and, hence, they are positioned very accurately with respect to the photosensitive member 43 and, further, even if the temperature within the image forming apparatus rises with continued operation of the apparatus, the body frame 15 exhibits little thermal expansion and hardly deforms.

The electrostatic latent image formed on the surface of the photosensitive member 43 is developed into a tonor image with tonor supplied by the developing device 45 and the tonor image is transferred in the transfer device 47 to recording paper P sent from the paper supply tray 72.

The recording paper P with the tonor image transferred thereto is sent to the fixing device 61, in which it, while being transported, is sandwiched between the heat roller 62 and the pressing roller 63. Thereby, the tonor image is melted and fixed on the recording paper P. The recording paper P thus printed is discharged to the outside by discharge rollers 89.

The above described image forming apparatus of the embodiment has the following advantages. First, the optical parts (such as the polygon mirror 53) constituting the exposure device 51 are stably supported and, further, accurately positioned with respect to the photosensitive member 43 fixed to the same body frame 15. Accordingly, images of improved quality can be obtained.

As another advantage, the body frame 15 is formed such that it also serves as the optical frame and the optical parts (such as the polygon mirror 53) constituting the exposure device 51 are held in the optical frame portion 17 incorporated in the body frame 15. Accordingly, the need for providing the optical frame separately from the body frame 15 can be eliminated and, hence, downsizing of the apparatus and reduction of the cost of parts can be attained. In addition, such steps as to fix the exposure device 51 to the optical frame and to fix the optical frame to the body frame 15 can be omitted and, thus, fabrication of the apparatus becomes easier and the cost of manufacturing can be reduced.

As a further advantage, the body frame 15 also serves as the outer case and, therefore, still more downsizing and cost reduction can be attained.

As still another advantage, since the exposure device 51 is provided below the process unit 42 and the paper transport path 85, the need for moving the exposure device 51 when attaching and detaching the process unit 42 or disposing of jammed paper or the like can be eliminated. Hence, attaching and detaching of the process unit 42, disposing of the jammed paper, and the like can be made more speedily and easily.

As another advantage, the exposure device 51 can be directly fixed on the body frame 15 which is highly rigid and heavy by having a number of component parts fixed thereon and, therefore vibration or noise due to rotation of the polygon mirror 53 can be effectively suppressed.

As another advantage, since the exposure device 51 is provided below such heat sources as the fixing device 61, it is hardly affected by hot air currents ascending from the heat sources such as the fixing device 61. Also from this point of view, quality of images can be improved.

As an additional advantage, the exposure device 51 is fixed to the bottom side of the body frame 15 and, therefore, the center of gravity of the apparatus is lowered and installation of the apparatus can be stabilized.

The present invention has been described with respect to a specific embodiment. However, other embodiments based on the principles of the present invention should be obvious to those of ordinary skill in the art. Such embodiments are intended to be covered by the claims.

What is claimed is:

1. An image forming apparatus for forming an image on recording paper through electrophotographic processes, comprising:

a process unit having a photosensitive member for sequentially performing electrophotographic processes from charging said photosensitive member to developing an image thereon;

an exposure device for radiating light in accordance with printing data on said photosensitive member after the charging process has been performed by said process unit;

a transfer device for transferring, after the developing process has been performed by said process unit, the developed image on said photosensitive member to said recording paper;

a fixing device for fixing the image transferred to recording paper by said transfer device;

a paper supply device for supplying said recording paper to said process unit;

a paper transport device for guiding recording paper supplied by said paper supply device along a predetermined guide path including said process unit and said fixing device; and a body frame covered by an outer case and integrally formed of a main frame portion and an optical frame portion, said main frame portion being provided with positioning references of said process unit, said fixing device, said paper supply device, and said paper transport device and having said process unit, said fixing device, said paper supply device, and said paper transport device fixed thereon, and said optical frame portion being provided with positioning references of optical parts constituting said exposure device and having said optical parts fixed thereon;

wherein said body frame is formed of a material having a small coefficient of thermal expansion.

2. An image forming apparatus according to claim 1, wherein the material having a small coefficient of thermal expansion of which said body frame is formed is a synthetic resin material containing polycarbonate, ABS resin, and glass as main components thereof.

3. An image forming apparatus according to claim 1, wherein said main frame portion and said optical frame portion are formed on different sides of said body frame.

4. An image forming apparatus according to claim 3, wherein said optical frame portion is formed on the back side of said main frame portion and disposed below said main frame portion.

5. An image forming apparatus according to claim 4, wherein said optical frame portion is formed by depressing the bottom side of said body frame.

6. An image forming apparatus according to claim 4, wherein said exposure device includes a deflecting portion for deflecting light emitted from a light source, one reflecting mirror for reflecting the deflected light by said deflecting portion such that the light is turned back virtually in a direction of incidence, and another reflecting mirror for reflecting the reflected light by said one reflecting mirror in a direction of said process unit passing through said body frame.

7. An image forming apparatus according to claim 6, wherein a dustproof glass is fitted in a portion of said body frame through which the reflected light by said reflecting mirror is passed.

8. An image forming apparatus according to claim 4, further comprising an opening formed in a top side of said outer case and a movable cover attached for opening and shutting said opening formed in said outer case.

9. An image forming apparatus according to claim 8, wherein said paper supply device is made up of a paper supply roller and a paper pressing plate abutting on said paper supply roller, and said paper supply roller and said movable cover have a common rotational axis.

10. An image forming apparatus according to claim 8, wherein said guide path is located between said process unit and said movable cover.

11. An image forming apparatus according to claim 1, wherein said body frame is formed, such that it also serves as said outer case.

12. An image forming apparatus for forming an image on a medium through an electrophotograph process according to externally supplied printing data, comprising:

a photosensitive member;

a charging device for charging a surface of said photosensitive member up to a predetermined potential;

an exposure device for radiating light in accordance with printing data on said photosensitive member, said exposure device having a deflecting element for deflecting light and an optical element leading the light from said deflecting element to said photosensitive member;

a developing device for developing said exposed photosensitive member to thereby form a visible image thereon;

a transfer device for transferring a developed visible image to a medium;

a fixing device for fixing a visible image on a medium;

a detachable process unit holding said photosensitive member and holding at least either of said charging device and said developing device;

an outer case which defines an inner space;

a body frame dividing the inner space of said outer case in at least two sections;

a main frame portion defined on one side of said body frame, said main frame portion having a first and second portion, said first portion holding said process unit and said second portion holding said fixing device; and an optical frame portion defined on the other side, opposite to said one side, of said body frame, said optical frame portion having a third and a fourth portion, said third portion holding said deflecting element and said fourth portion holding said optical element;

wherein said body frame is formed of a material having a small coefficient of thermal expansion.

13. An apparatus according to claim 12, wherein said outer case holds said transfer device and includes a movable cover for closing said inner space.

14. An apparatus according to claim 12, wherein said medium is recording paper and said apparatus further comprises a paper supply device for supplying said recording paper to said photosensitive member.

15. An apparatus according to claim 12, wherein the material having a small coefficient of thermal expansion of which said body frame is formed is a synthetic resin material containing polycarbonate, ABS resin, and glass as main components thereof.

16. An apparatus according to claim 12, wherein a dust-proof glass is fitted in a portion of said body frame at which light from said deflecting element is led to said photosensitive member penetrating a boundary between said main frame portion and said optical frame portion.

* * * * *